US006450693B1

(12) United States Patent
Fuchs et al.

(10) Patent No.: US 6,450,693 B1
(45) Date of Patent: Sep. 17, 2002

(54) BEARING ARRANGEMENT FOR A SHAFT SUPPORTING A ROTATING TOOL

(75) Inventors: Rainer Fuchs, Grävenwiesbach; Ruprecht Maurer; Karlheinz Timtner, both of Bad Homburg vor der Höhe, all of (DE)

(73) Assignee: Ringspann GmbH, Bad Homburg (DE)

( * ) Notice: Subject to any disclaimer, the term of this patent is extended or adjusted under 35 U.S.C. 154(b) by 22 days.

(21) Appl. No.: 09/707,525

(22) Filed: Nov. 7, 2000

(30) Foreign Application Priority Data

Nov. 26, 1999 (DE) ..... 199 56 942

(51) Int. Cl.[7] ..... F16C 43/04
(52) U.S. Cl. ..... 384/538
(58) Field of Search ..... 384/538, 537, 384/584, 585

(56) References Cited

U.S. PATENT DOCUMENTS 1,116,845 A * 11/1914 Rogers ..... 384/538
1,524,999 A * 2/1925 Sandberg ..... 384/538
3,807,820 A * 4/1974 Schuhmann ..... 384/538
5,174,661 A * 12/1992 Nicolas et al. ..... 384/538
5,897,214 A * 4/1999 Nisley ..... 384/537

FOREIGN PATENT DOCUMENTS

DE 3215618 * 10/1983
EP 0163104 12/1985

OTHER PUBLICATIONS

Examination Report from German Priority Application No. 199 56 942.8 dated Sep. 29, 2000 (and translation of pertinent portion).

* cited by examiner

*Primary Examiner*—Thomas R. Hannon
(74) *Attorney, Agent, or Firm*—Volpe and Koenig, P.C.

(57) ABSTRACT

A bearing arrangement for a shaft supporting a rotating tool is provided, with the shaft being rotatable on both sides of the tool at least indirectly in roller bearings, one of which can be removed for purposes of tool replacement together with an associated bearing sleeve slidable onto the free shaft end. The seating of the bearing sleeve, which is borne at least indirectly by the shaft, is formed by a conical outer surface tapering toward the shaft end. The bearing sleeve exhibit a conical borehole corresponding to the conical outer surface, and the bearing sleeve is radially expanded via a stop-limited axial shifting with respect to the conical outer surface by an amount to produce a specific level of reduced roller-bearing play.

17 Claims, 4 Drawing Sheets

BEARING ARRANGEMENT FOR A SHAFT SUPPORTING A ROTATING TOOL

BACKGROUND

The present invention concerns a bearing arrangement for a shaft supporting a rotating tool, with the shaft being axially unshiftable in a fixed roller bearing on one side of the tool and rotatable at its free end on the other side of the tool at least indirectly in a roller bearing which is axially removable for replacement of the tool, the latter bearing being axially secured with its outer ring in a shiftable bearing block and secured inwardly possibly via an inner ring on a bearing sleeve slidable onto the free shaft end.

Such a bearing arrangement finds use especially in rolling mills in which the profiling rolls serving as tools need to be replaced relatively often, for which purpose one of the roller bearings needs to be removed in order to be able to remove the profiling roll from the shaft and replace it with another profiling roll. However, further applications are also conceivable for such a bearing arrangement, for example, in portal milling machines in which a bearing of the milling shaft likewise needs to be removed for tool replacement. In describing the present invention in the following, for purposes of simplicity, reference is made only to its use in rolling mills without any intention, however, of limiting the range of application of the present invention.

In modern heavy-duty rolling mills such as are used, for example, in manufacturing thick-walled precision tubes, a high rotational accuracy of the replaceable profiling rolls is required, which should be better than 0.01 mm, if possible. In addition, high rolling forces need to be produced, which assumes a corresponding rigidity of the roll-supporting frame. Since the rolls often need to be changed several times in a day, such replacement must be possible in a short time in order to keep production costs as low as possible. Finally, long operating periods and short periods for maintenance and servicing are required.

It follows from this list of requirements that the rolls need to be positioned between two roll stands having roller bearings for the roll shaft. Rolls positioned on overhung shafts, commonly employed for easy and rapid replaceability, can not be used since such rolls do not permit the occurrence of high rolling forces.

With respect to the required long operating periods and freedom from maintenance, all of the structural elements used in the bearing arrangement additionally need to be durable. In particular, no fretting corrosion may occur at the points of contact between highly stressed parts.

Designs known up to now could not supply any technically satisfactory solution for the arrangement of the removable roller bearing since, in these designs, the roller bearing is slid via a bearing sleeve with cylindrical borehole onto a cylindrical outer surface of the free end of the shaft, with the result that fretting corrosion forms after a short period at this interface, which exhibits slight play for assembly reasons, due to the micromovements caused by the rolls.

SUMMARY

The object of the present invention is therefore to develop, for a bearing arrangement of the above-mentioned type, a shiftable bearing for tool replacement such that the associated structural elements are arranged mutually play-free and additionally make possible a reduction of the bearing play fundamentally inherent in the associated roller bearing. Here, the new design should range within the framework of the previous cost of structural parts and should be relatively simple and economical.

Based on a bearing arrangement of the type mentioned above, this problem is solved according to the present invention in that the seating of the bearing sleeve borne at least indirectly by the shaft is formed by a conical outer surface that tapers toward the shaft end, that the bearing sleeve includes a conical borehole corresponding to the conical outer surface, and that the bearing sleeve is radially expanded via a stop-limited axial shifting with respect to the conical outer surface by an amount giving a specific level of reduced roller-bearing play.

These inventive measures have the effect that the press fit of the bearing sleeve on the free shaft end, a fit which can be loosened for removal of the roller bearing, is now pretensioned in the assembled state and therefore designed to be completely free of play. Therefore, the conditions for forming fretting corrosion there are eliminated. In addition, as a result of the conical seating of the bearing sleeve on the free shaft end, the bearing sleeve can be expanded by a specific amount through corresponding shifting with respect to the free shaft end so that the bearing play fundamentally inherent in the roller bearing can be reduced, if necessary, to a minimum through simultaneous corresponding expansion of the roller-bearing inner ring. Here, the degree of this expansion is limited or defined by the mentioned stop for the shifting of the bearing sleeve so that, after removal of the roller bearing for changing of the profiling rolls, reinstallation of the roller bearing again produces the same seating conditions.

In this way, a bearing arrangement for the profiling rolls of rolling mills is provided which can accommodate large roll forces with maximum rotational accuracy without the danger that manifestations of wear can be produced within the removable bearing system through the formation of fretting corrosion. On the other hand, the design of the present invention ranges as regards its construction costs and space requirements within the previous framework and thus avoids additional expenditures for maintenance and servicing. At the same time, an increase in service life is possible through elimination of wear possibilities.

The conical outer surface can be formed directly by the free end of the shaft. However, depending on the details of machine design, especially with regard to the mounting of the profiling rolls, the conical outer surface can also be formed by a metal conical sleeve tightly joined to the free shaft end. The sleeve permits the assembly of structural parts for securing the profiling rolls prior to its positioning on the free shaft end. In order that freedom from play between the conical sleeve and the shaft end is now also guaranteed, it is appropriate to shrink-fit the conical sleeve on the free shaft end. Instead of this or also additionally, it can be provided that the conical sleeve abuts on the end wall of the free shaft end via a radially inwardly directed circular flange, and that flange and shaft end are detachably joined together via screw means.

With respect to the taper of the mating conical outer surface at the shaft end and the conical borehole of the bearing sleeve with respect to their axis, this appropriately exhibits an angle above the effective angle of friction so that no additional resistance opposes the loosening of the removable bearing. Assuming that the mating of the conical outer surface and the conical borehole is appropriately lubricated with molybdenum disulfide, a conical angle of about 7° with respect to the shaft axis can be utilized.

With respect to the more detailed construction of the seating of the bearing sleeve on the free shaft end, it has proven advantageous for the bearing sleeve to include a radially inwardly directed collar as a stop, and for the collar with its radial surface facing the shaft to be held in contact with the radial end wall of the free shaft end or the free end wall of the conical sleeve. It is advantageous for this mounting arrangement that a protruding fastening bolt be secured in a concentric borehole of the free shaft end, that a disk-shaped tightening plate in contact with the collar be located in a terminal, axis-parallel, collar-bordering borehole of the bearing sleeve, that the fastening bolt penetrate a central borehole of the tightening plate with its end exhibiting external threading, and that the collar of the bearing sleeve be tightened against the end wall of the shaft end or the conical sleeve by a nut screwed on the external threading against the tightening plate. Here, in order to facilitate assembly, the tightening plate can be removably joined with the bearing sleeve via screw means connecting it with the collar.

As already described, by placing the collar of the bearing sleeve against the end wall of the free shaft end, the radial expansion of the bearing sleeve and, if necessary, the inner ring of the roller bearing is basically predetermined, and thus the restriction of roller bearing play in its order of magnitude. However, in order to ensure maximum precision here and compensate for any production tolerances or eliminate their effects, it has proven to be advantageous in final machining of the roller-bearing-supporting cylindrical outer surface of the bearing sleeve for the sleeve collar to be tightenable against the involved end wall via screw means penetrating the collar and passing into the end wall of the shaft end or the conical sleeve. Here, the bearing sleeve is thus temporarily mounted in secure fashion on the shaft end or on the conical sleeve borne by the shaft end without the subsequently employed means in the form of tightening plate and fastening bolt in a manner which withstands the forces occurring during the machining of the outer surface of the bearing sleeve. Now the shaft can be supported between tips in a suitable tooling machine and the final finishing of the outer surface of the bearing sleeve can be undertaken to such an extent as corresponds to the desired reduction of play in the roller bearing subsequently borne by the outer surface.

In order that the result of this highly precise finishing is also retained during later use, it is appropriate that the mutual position of bearing sleeve and shaft or conical sleeve be fixed in the peripheral direction. This positioning can be provided by an index pin extending parallel to the axis of the shaft and into a borehole in the collar and the end wall or the conical sleeve.

In order to keep impurities from getting into the conical mating between the shaft end or conical sleeve and the bearing sleeve during operation, it is advantageous for the bearing sleeve to include a circular seal in contact with the neighboring inner part in the area of its end surrounding the shaft.

Finally, the bearing sleeve can be designed as a structural unit closed in the peripheral direction. The radial expansion of the bearing sleeve resulting during tightening is only in the range of a few 1/100 mm at a distance of about 0.6 mm between the collar of the bearing sleeve and the end wall of the shaft or the conical sleeve prior to tightening. Depending on the circumstances of the individual case, there exists, however, the possibility for providing the bearing sleeve with longitudinal slots for easier expansion. However, in this case, the longitudinal slots should appropriately be filled in with elastic sealing material in order to prevent penetration of dirt into the area of the conical mating of bearing sleeve and shaft or conical sleeve.

BRIEF DESCRIPTION OF THE DRAWINGS

Further features and details of the present invention are provided in the following description of the embodiments shown in the drawings. In the drawings.

DETAILED DESCRIPTION OF THE PREFERRED EMBODIMENT(S)

Figure 1:
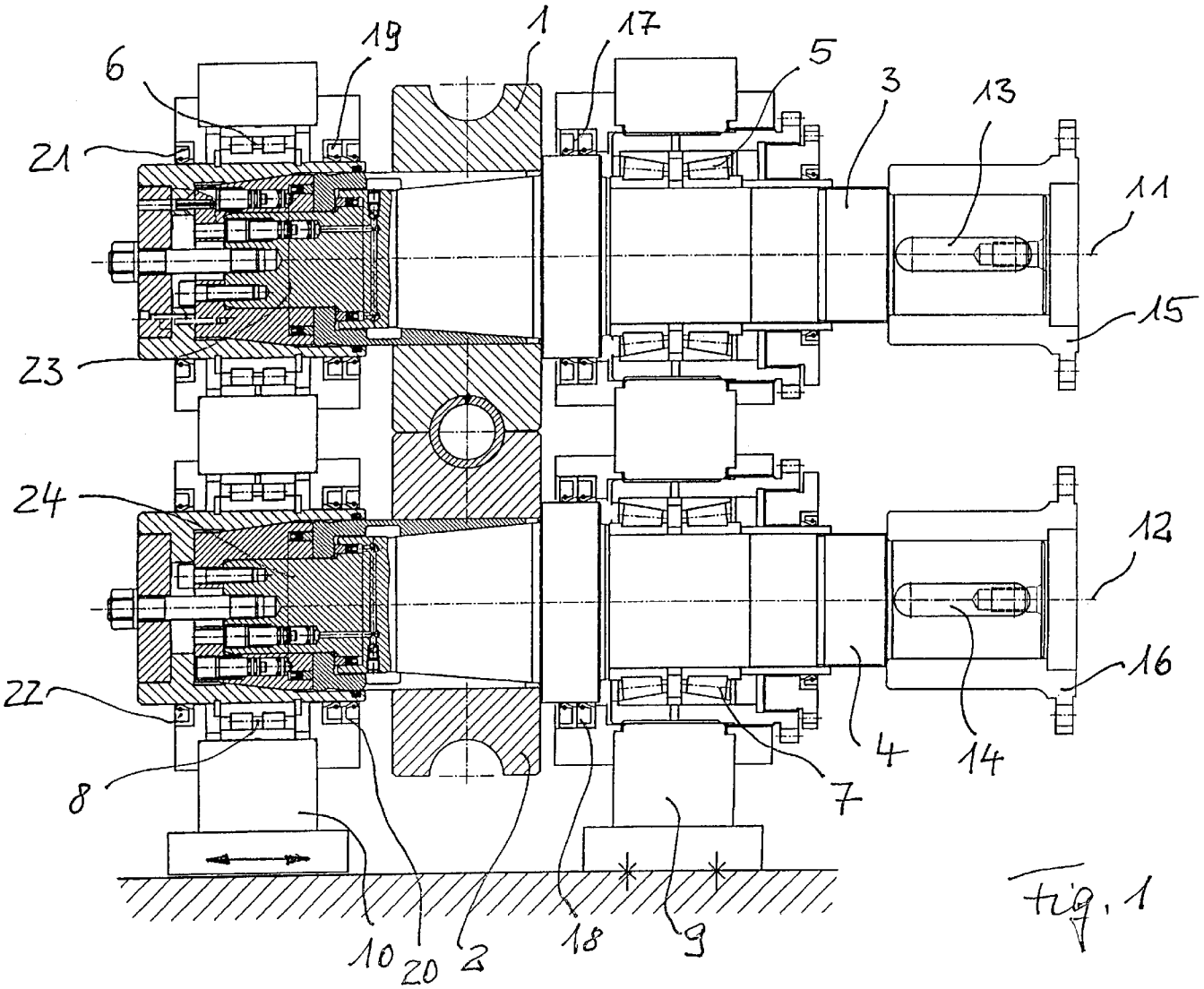
FIG. 1 is a sectional view of a roll-supporting frame.

FIG. 1 shows a sectional view of a roll-supporting frame with shafts 3,4 that support profiling rolls 1,2 which are rotatable at least indirectly in roller bearings 5–8 located on both sides of the profiling rolls 1,2. The roller bearings are seated in roll stands 9,10, of which roll stand 9 is fixed in place with its associated roller bearings 5,7, while roll stand 10 with its associated roller bearings 6,8 can be shifted away in the direction of the shaft axes 11,12 in order to make possible replacement of profiling rolls 1,2. Further shown at the right end of shafts 3,4 are coupling hubs 15,16 rotationally fixed to the shafts via keys 13,14 and serving in connecting shafts 3,4 to unshown drives.

In the present case, the roller bearings 5,7 positioned in the stationary roll stand 9 are designed as radial-axial bearings in order to support axial forces also acting on shafts 3,4. Accordingly, shafts 3,4 are axially fixed in position in roller bearings 5,7 in a known manner, which is therefore not described in detail herein. In contrast, roller bearings 6,8 in roll stand 10 are pure radial bearings. Moreover, insofar as is required, all of the roller bearings are additionally protected in known fashion against dirt and contamination through incorporation of seals 17–22.

Figure 2:
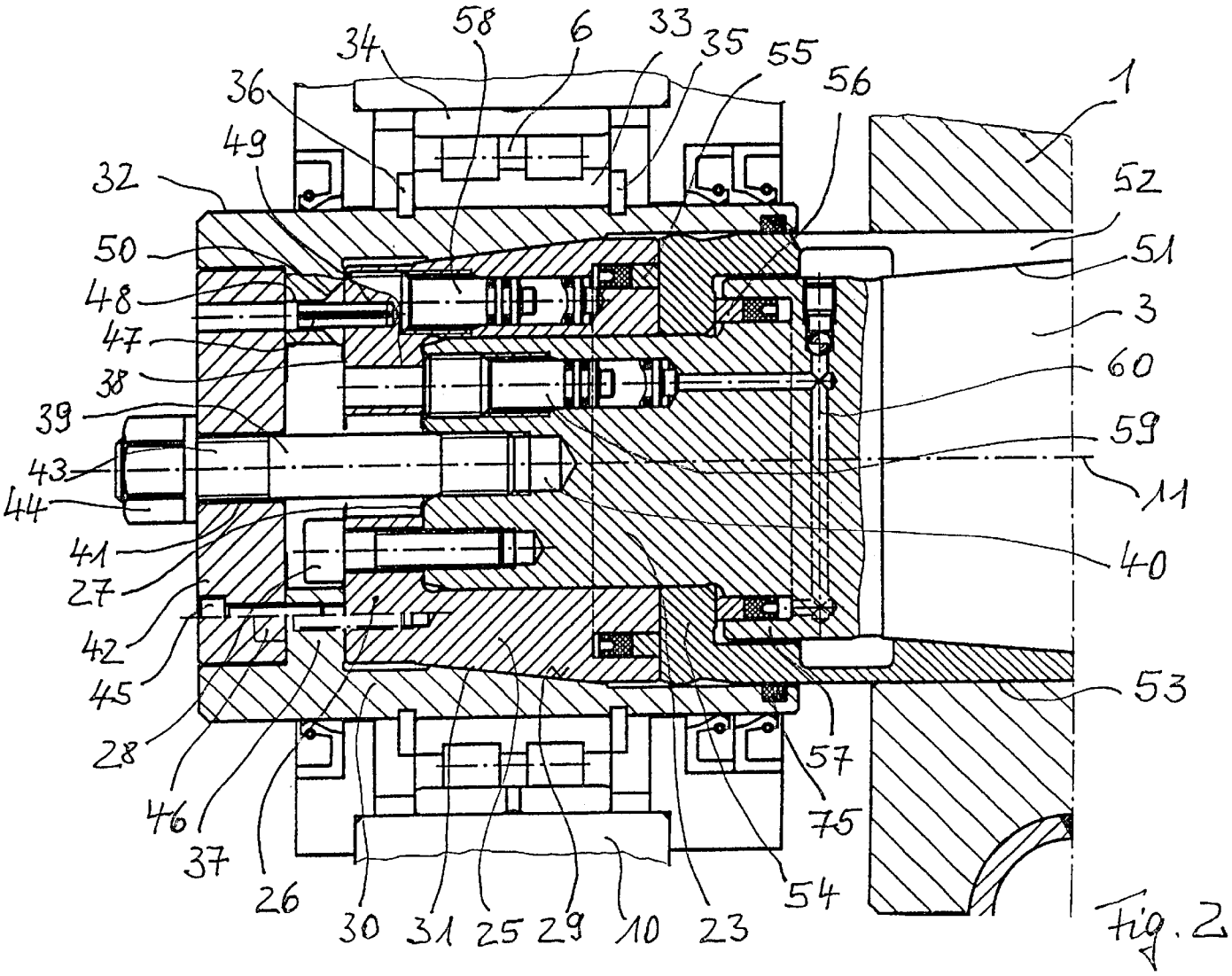
FIG. 2 is an enlarged view of a removable bearing from FIG. 1.

The support of the free shaft ends 23,24 in roller bearings 6,8 as well as the releasable securing of profiling rolls 1,2 on shafts 3,4 is now explained in more detail with respect to FIG. 2, which shows in enlarged fashion the free end 23 of shaft 3 with roller bearing 6 and profiling roll 1.

As can be seen from FIG. 2, a sleeve 25 sits on the cylindrical outer surface of the free shaft end 23 such that it is in contact via a radially inwardly directed flange 26 with the radial end wall 27 of shaft end 23, this contact being fixed by several screws 28 distributed around the periphery. Furthermore, the sleeve 25 can additionally be secured to the cylindrical outer surface of shaft end 23 by a shrink fit.

The outer surface of sleeve 25 is formed by a cone 29 tapering toward the end wall 27 of free shaft end 23, and a bearing sleeve 30 with a correspondingly shaped conical borehole 31 is seated thereon. The bearing sleeve 30 supports on its cylindrical outer surface 32 the inner ring 33 of roller bearing 6. The outer ring 34 of the roller bearing 6 is seated in a corresponding borehole of the roll stand 10. The inner ring 33 of the roller bearing 6 is axially secured on the outer surface 32 of bearing sleeve 30 by snap rings 35,36 located on the sleeve. At its end facing the profiling roll 1, the bearing sleeve 30 includes a circular seal 75 in contact with the neighboring inner part in order to prevent the penetration of dirt into the conical mating of the conical sleeve 25 and the bearing sleeve 30.

In a modified design compared to the representation in FIG. 2, one can forgo the inner ring 33 of the roller bearings 6 and 8 since the bearing sleeve 30 is hardened so that its outer surface 32 can serve as the race for the rollers of the roller bearing. In this case, the axially securing snap rings 35,36 are retained, but at such a distance from the rollers that they do not adversely affect roller movement.

The bearing sleeve 30 includes a radially inwardly directed collar 37 with which it contacts the free radial end wall 38 of the conical sleeve 25, the bearing sleeve 30 as well as the inner ring 33 of the roller bearing 6 being radially expanded to such a degree through the effect of conical mating 29,31 that the bearing sleeve 30 is seated free of play on the conical sleeve 25 and the radial play fundamentally inherent in the roller bearing 6 is reduced to a specific level.

To produce this tightening of the bearing sleeve 30 on the conical sleeve 25, and thus on free shaft end 23, a fastening bolt 39 is used, which is secured, for example, tightly screwed, in a concentric hole 40 in the free shaft end 23. The fastening bolt 39 penetrates through a central borehole 41 in a disk-shaped tightening plate 42, which is located on the shaft-opposing side in contact with the collar 37. A nut 44 is screwed on a terminal threading 43 of the fastening bolt 39, against tightening plate 42, through which the collar 37 is drawn against end wall 38. In order to join tightening plate 42 reliably but removably with bearing sleeve 30, one can use screws 45 penetrating tightening plate 42 and passing into tapped holes in collar 37.

In order to definitively achieve the dimensions of the cylindrical outer surface 32 of bearing sleeve 30 corresponding to the desired specifications, it can be provided that this finishing process occur with bearing sleeve 30 mounted on shaft end 23 and conical sleeve 25, for which purpose then shaft 3 is fixed between the tips of a suitable finishing machine. The profiling roll 1, with attachment means still to be described, is naturally not yet installed for this finishing. In addition, fastening bolt 39 as well as tightening plate 42 with its securing means 45 are left out here. Instead, collar 37 is tightened against end wall 38 of conical sleeve 25 by subsequently eliminated screws 46 distributed around the periphery. Taking place here simultaneously is a final positioning of the bearing sleeve 30 with respect to the conical sleeve 25 in the peripheral direction via an index pin 47, which is slidably received in a borehole 48 in the collar 37 of the bearing sleeve 30 and permanently in a borehole 49 of the flange 26 of the conical sleeve 25. The borehole 48 exhibits a conical expansion 50 in the direction toward the collar 37 in order to facilitate proper seating of the bearing sleeve 30. As mentioned above, the screws 46 are removed again after finishing of the outer surface 32 of the bearing sleeve 30, and the bearing sleeve 30 is then equipped with the tightening plate 42 and the fastening bolt 39 is inserted in the shaft 3.

As can be seen, the described construction makes it possible to free the bearing sleeve 30 sitting on shaft ends 23,24 (FIG. 1) through simple removal of the nuts 44 so that the roll stand 10 together with the roller bearings 6,8 can be moved off these shaft ends in order to free the shaft ends for changing of the profiling rolls 1,2, for which purpose (to mention this here just once for purposes of completeness) the maximum outer diameter of cone 29 or and the structural element bearing same is naturally smaller than the diameter of the borehole of profiling rolls 1,2. Subsequently, the roll stand 10 can be moved back again into the position shown in FIGS. 1 and 2, the bearing sleeves 30 can be adjusted using index pin 47 in the peripheral direction with respect to the conical sleeves 25, and the bearing sleeves 30 can finally be moved back into the position shown in the drawing by screwing on nuts 44, to a position in which they sit play-free on the conical sleeves 25 and limit the radial play of the roller bearings 6,8 to the predetermined level.

Serving in securing the profiling rolls 1,2 is a system that is shown in detail in FIGS. 1 and 2, in which a sleeve 52 having a conical borehole tapering toward free shaft end 23 or 24 and shovable onto a conical outer surface 51 of shafts 3,4 as well as a cylindrical outer surface fitting into the cylindrical receiving borehole 53 of profiling rolls 1,2. If sleeve 52 is shifted to the right (based on FIGS. 1 and 2) onto the conical outer surface 51 of the shaft 3 or 4, it experiences an expansion through which the associated profiling roll 1 or 2 is fixed on the shaft 3 or 4.

In order to accomplish the shifting of the sleeve 52, the sleeve is trapped in the area of the free shaft ends 23,24 via a terminal radially inwardly directed collar 54 between hydraulically manipulatable annular pistons 55,56 which can be shifted parallel to the shaft axis 11 or 12, on the one hand, in the end wall of conical sleeve 25 facing the collar 54 and, on the other hand, in an end wall formed by a shoulder 57 in the shaft 3 or 4 using the action of hydraulic fluid. Here, the mentioned end wall of the conical sleeve 25 and that of the shoulder 57 of the shaft 3 or 4 are at such a distance exceeding the axial width of collar 54 that the collar 54 can be shifted axially between these end walls by an amount serving in tightening and releasing sleeve 52.

The hydraulic fluid is supplied to the annular piston 55 or 56 by actuating power pistons 58,59 which sit in tapped holes in the conical sleeve 25 or the free shaft end 23,24 and can be accessed via screw means at their end opposite the hydraulic system using boreholes in the conical sleeve 25 or its flange 26. If now, for example, the power piston 59 is screwed from the left to the right (based on FIG. 2) by the mentioned screw means, it forces hydraulic fluid via line 60 to the back side of annular piston 56, through which the latter is shoved to the left in the position shown in FIG. 2, which leads to a shifting of sleeve 52 to the left and thus to a loosening of the mounting of profiling roll 1 or 2. Conversely, a corresponding movement of the power piston 58 toward the right leads to a similarly directed shifting of the hydraulically connected annular piston 55 as well as the sleeve 52 and thus to a tightening of the profiling roll 1 or 2 on its associated shaft 3 or 4.

Figure 3:
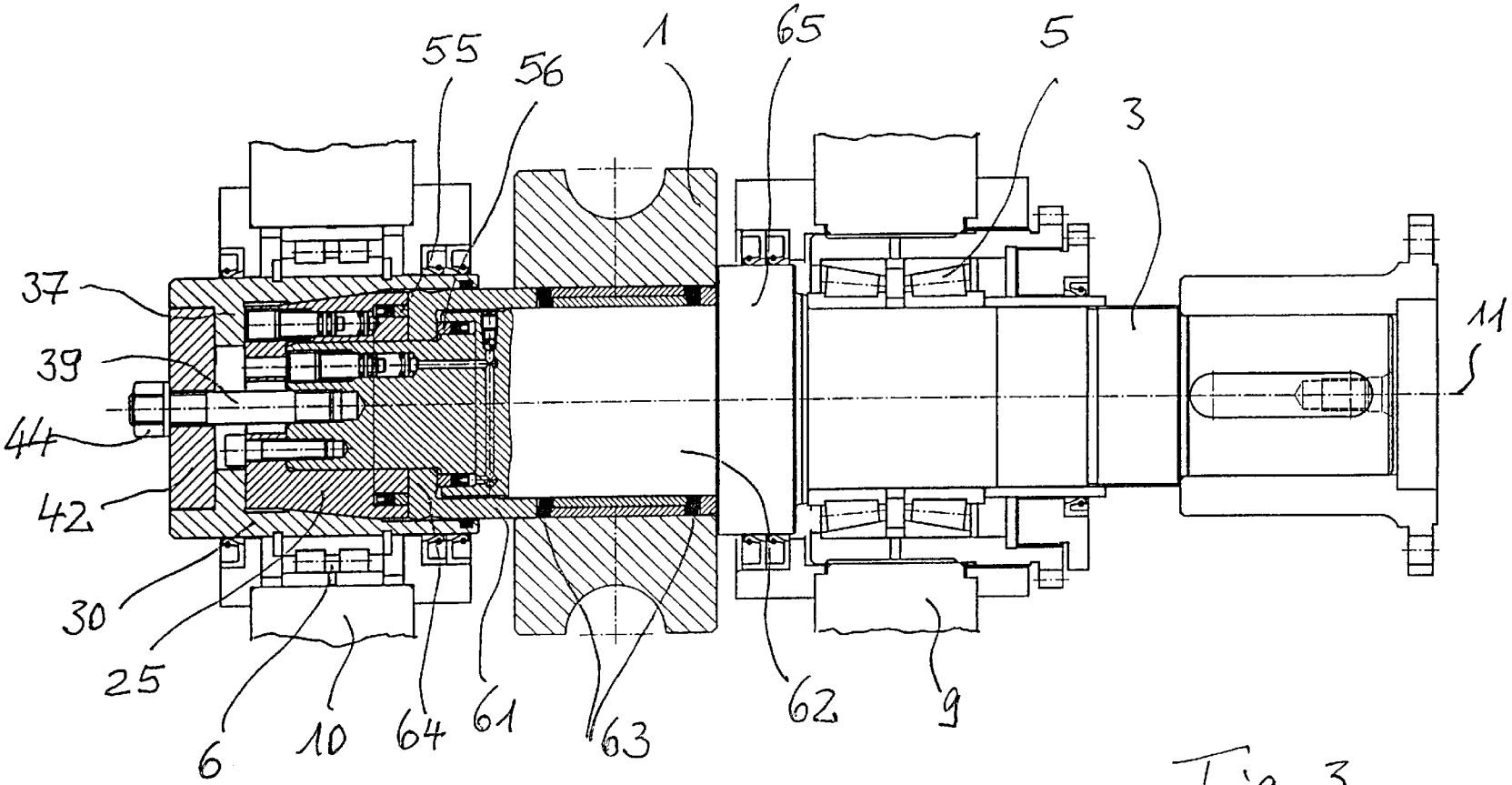
FIG. 3 is a view of a roll shaft from FIG. 1 with a modified design of securing of the profiling roll.

The subject of FIG. 3 corresponds essentially to the subject described in FIGS. 1 and 2, and reference is thus made to the above description. However, a difference is the fact that the sleeve 52 according to FIG. 2 with the conical borehole mating with a corresponding conical seat 51 of shaft 3 or 4 is replaced in the embodiment according to FIG. 3 by a sleeve 61 with a cylindrical outer surface and a cylindrical borehole for seating on a cylindrical shaft section 62, on which at least one radial tensioning element is positioned play-free in the area of the inner diameter of the profiling roll 1 which, via the tightening force acting in the axial direction, enlarges its outer diameter, through which the profiling roll 1 is clamped or fixed on the shaft section 62. In FIG. 3, for example, two similar packs 63 positioned next to each other in the direction of axis 11 are shown as radial tensioning elements known as so-called "RING-SPANN" disks. The tightening force is applied, in turn, through axial movement of the sleeve 61 via its collar 64 through the action of the annular piston 55, with the sleeve 61 being supported at the other end against the collar 65 of the shaft 3.

In order to loosen this tensioned union between shaft section 62 and profiling roll 1, the sleeve is again released toward the left by the annular piston 56 in the manner already described so that the pack 63, formed of cup springs or annular tensioning elements, can relax.

Figure 4:
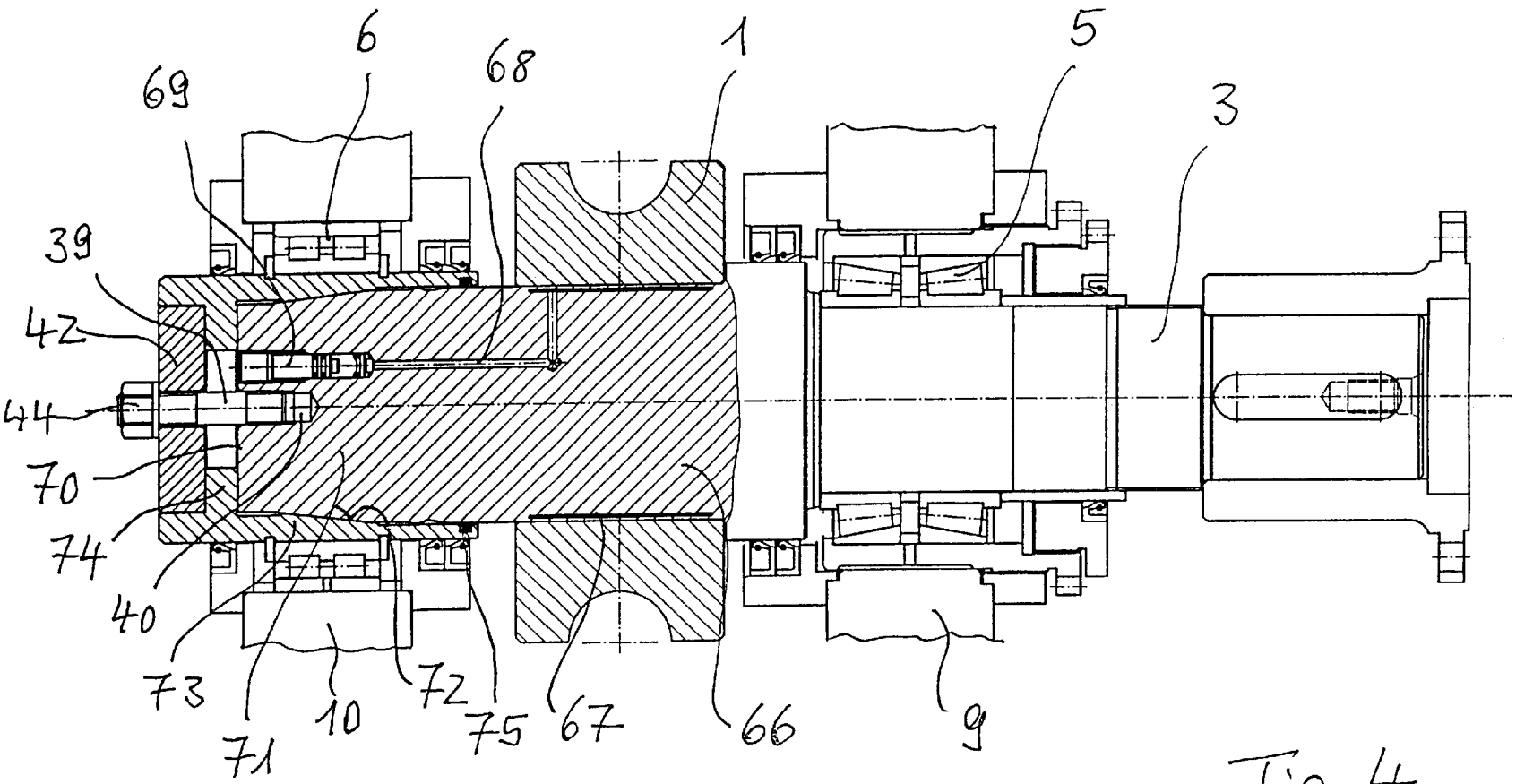
FIG. 4 is a view of a roll shaft with a modified design of the removable bearing and securing of the profiling roll.

Finally, FIG. 4 shows another embodiment in which the mounting of the profiling roll 1 can occur on a cylindrical section 66 of the shaft 3 also using an expanding tensioning sleeve 67 tightly secured via its axial ends on the shaft section 66. The sleeve can be directly loaded from the inside with hydraulic fluid via a line 68 by a power piston 69, which is screwed in from the end wall 70 of the free shaft end 71 into a tapped hole. If the power piston 69 is turned from its accessible end by screw means into the borehole in the shaft end 71 accepting it, it forces the hydraulic fluid located ahead of it via line 68 to the inside of the tensioning sleeve 67, through which this sleeve is forced radially outwardly and thus fixes profiling roll 1 on shaft section 66.

A mounting mechanism of the type shown in FIG. 4 now offers, however, the possibility for forming the conical outer surface 72 for securing the bearing sleeve 73 for the roller bearing 6 directly on the free end 71 of the shaft 3. Moreover, what has been said in discussing FIGS. 1 and 2 applies equally for the bearing sleeve 73 with its collar 74 acting against the end wall 70 of the shaft end 71, for which reason the details presented there concerning screws 45,46, index pin 47, etc., are not presented here once again for purposes of simplicity. Only fastening bolt 39, tightening plate 42, and tightening nut 44 are once again illustrated.

What is claimed is:

1. Bearing arrangement for a shaft supporting a rotating tool, the shaft being axially unshiftable in a fixed roller bearing on one side of the tool and rotatable at its free end on the other side of the tool at least indirectly in a second roller bearing which is axially removable for replacement of the tool, the second bearing having an outer ring and being axially secured by the outer ring in a movable bearing block and having an inner part that is secured on a bearing sleeve that is slidable onto a free end of the shaft, characterized in that the bearing sleeve (30,73) borne at least indirectly by the shaft (3,4) is seated on a conical outer surface (29,72) of the shaft tapering toward the shaft end, the bearing sleeve (30,73) includes a conical borehole (31) corresponding to the conical outer surface (29,72), and the bearing sleeve (30,73) is radially expanded via a stop-(37,74)-limited axial shifting with respect to the conical outer surface (29,72) by a predetermined amount to provide a specific level of reduced roller-bearing play.

2. Bearing arrangement according to claim 1, characterized in that the conical outer surface (72) is formed directly on the free shaft end (71).

3. Bearing arrangement according to claim 1, characterized in that the conical outer surface (29) is formed by a metal conical sleeve (25) joined to the free shaft end (23).

4. Bearing arrangement according to claim 3, characterized in that the conical sleeve (25) is shrunk-fit on the free shaft end (23).

5. Bearing arrangement according to claim 3, characterized in that the conical sleeve (25) abuts on an end wall (27) of the free end (23) of the shaft via a radially inwardly directed circular flange (26) and that the flange (26) and the shaft end (23) are detachably joined together via screw means (28).

6. Bearing arrangement according to claim 1, characterized in that the taper of the conical outer surface (29,72) and the conical borehole (31) with respect to the axis (11) has an angle above the effective angle of friction.

7. Bearing arrangement according to claim 6, characterized in that the angle is approximately 7° in the case of a lubricated interface.

8. Bearing arrangement according to claim 7, characterized in that the lubricated interface is lubricated with with molybdenum disulfide.

9. Bearing arrangement according to claim 1, characterized in that the bearing sleeve (30,73) includes a radially inwardly directed collar (37,74) and in that the collar (37,74) includes a radial surface facing the shaft (3) that is held in contact with the radial end wall (70) of the free shaft end (71) or a free end wall (38) of a conical sleeve (25) joined to the free shaft end.

10. Bearing arrangement according to claim 9, characterized in that a protruding fastening bolt (39) is secured in a concentric borehole (40) of the free shaft end (23,71), that a disk-shaped tightening plate (42) in contact with the collar (37,74) is located in a terminal, axis-parallel, collar-(37,74)-bordering borehole in the bearing sleeve (30,73), that the fastening bolt (39) extends through a central borehole (41) of the tightening plate (42) and includes an end having external threading, and that the collar (37,74) of the bearing sleeve (30,73) is tightened against the end wall (70) of the shaft end (71) or the end wall (38) of the conical sleeve (25) by a nut (44) screwed on the external threading against the tightening plate (42).

11. Bearing arrangement according to claim 10, characterized in that the tightening plate (42) is removably joined with the bearing sleeve (30,73) via screw means (45) connecting it with the collar (37,74).

12. Bearing arrangement according to claim 1, characterized in that in final machining of the roller-bearing-(6,8)-supporting cylindrical outer surface (32) of the bearing sleeve (30,73), a sleeve collar (37,74) is tightened against the end wall via screw means (46) penetrating the collar and passing into the end wall (70, 38) of the shaft end (71) or a conical sleeve (25) joined to the shaft end.

13. Bearing arrangement according to claim 1, characterized in that the mutual position of the bearing sleeve (30,73) and the free shaft end (23) or a conical sleeve (25) joined to the shaft end is fixed in a peripheral direction.

14. Bearing arrangement according to claim 13, characterized in that the positioning occurs via an index pin (47) that extends parallel to three axis of the shaft (3) and extending into a borehole (48) in a collar (37,74) tightened against the end wall and the end wall (70, 38) of the free shaft end (71) or the conical sleeve (25).

15. Bearing arrangement according to claim 1, characterized in that the bearing sleeve (30,73) includes a circular seal (75) in an area of an end surrounding the shaft (3) which is in contact with a neighboring inner part (52,71).

16. Bearing arrangement according to claim 1, characterized in that the bearing sleeve is provided with longitudinal slots.

17. Bearing arrangement according to claim 16, characterized in that the longitudinal slots are filled in with elastic sealing material.

* * * * *